United States Patent [19]

Richardson, Jr. et al.

[11] Patent Number: 4,917,581

[45] Date of Patent: Apr. 17, 1990

[54] MOUNTING BOOT FOR A HERMETIC COMPRESSOR

[75] Inventors: Hubert Richardson, Jr., Brooklyn; Phillip A. Tomell; Michael J. Maertens, both of Adrian, all of Mich.

[73] Assignee: Tecumseh Products Company, Tecumseh, Mich.

[21] Appl. No.: 243,316

[22] Filed: Sep. 12, 1988

[51] Int. Cl.[4] ..... F04B 39/00

[52] U.S. Cl. ..... 417/363; 417/902; 248/632; 248/634; 248/638; 248/678

[58] Field of Search ..... 417/363, 902, 360, 423.15, 417/424.1; 248/632, 634, 638, 678; 415/119

[56] References Cited

U.S. PATENT DOCUMENTS

| | | | |
|---|---|---|---|
| 1,574,985 | 3/1926 | McWain . | |
| 1,911,804 | 5/1933 | Carpenter . | |
| 1,947,501 | 2/1934 | Sharp . | |
| 2,935,279 | 5/1960 | LaPorte et al. . | |
| 2,964,236 | 12/1960 | Kasper | 417/363 |
| 2,973,895 | 3/1961 | Brown et al. | 417/363 |
| 3,199,774 | 8/1965 | Lowell | 417/363 |
| 3,286,960 | 11/1966 | Douglas et al. . | |
| 3,937,598 | 2/1976 | Stannow et al. | 417/363 |
| 4,461,446 | 6/1984 | Hannibal et al. . | |
| 4,569,637 | 2/1986 | Tuckey | 417/363 |
| 4,643,386 | 2/1987 | Chastine . | |

*Primary Examiner*—Leonard E. Smith
*Assistant Examiner*—Eugene L. Szczecina, Jr.
*Attorney, Agent, or Firm*—Jeffers, Hoffman & Niewyk

[57] ABSTRACT

A mounting boot for mounting a vertical hermetic compressor to a horizontal base, includes a resilient cup-shaped member to receive the bottom end of the compressor housing. A cylindrical inner wall surface of the cup-shaped member frictionally engages the sidewall of the compressor. The bottom end of the compressor housing comprises a plate member having a radially extending flange portion resiliently enveloped by the inner wall surface of the cup-shaped member. The bottom end of the compressor housing is spaced from the bottom wall of the mounting boot, thereby defining an enclosed muffling chamber to suppress noises radiated from the compressor bottom end. The mounting boot is formed with radially extending mounting feet, and passages through which compressor inlet and outlet tubes may extend.

31 Claims, 2 Drawing Sheets

MOUNTING BOOT FOR A HERMETIC COMPRESSOR

BACKGROUND OF THE INVENTION

The present invention relates generally to hermetic compressors of the type commonly installed in appliances, such as refrigerators, freezers, air conditioners, dehumidifiers, etc. More particularly, the invention pertains to a mounting apparatus for mounting such a compressor in an upright manner to a horizontal support surface associated with an appliance frame, enclosure, or cabinet.

In a hermetic compressor of the type to which the present invention pertains, a motor compressor unit is operably disposed within a hermetically sealed outer housing. A hermetic electrical terminal and refrigeration fluid conduits extend through the sidewall of the housing and provide external access to the motor compressor unit contained therein. Accordingly, the hermetic compressor is easily incorporated into an appliance by simply mounting the compressor to the appliance cabinet and making the necessary electrical and refrigeration fluid connections. Because it is well known that hermetic compressors generate undesired noise and vibration, it is desired to mount the compressor to the appliance cabinet in such a manner as to suppress the noise and vibration and to absorb shock.

Several methods are known for mounting a hermetic compressor in an appliance cabinet and, more specifically, for mounting the compressor to a horizontal support surface in an upright position. For example, it is known to weld a base plate to the bottom of the compressor housing, wherein the base plate is provided with a plurality of holes into which grommets are forcibly fit. Each grommet includes an aperture which houses a sleeve through which a nut and bolt assembly is received to secure the compressor and plate to the appliance. Similarly, it is known to weld a plurality of supporting legs to the compressor housing, which are then placed upon posts with resilient means interposed between the legs and the horizontal support surface.

Each of the aforementioned prior art mounting methods requires that mounting apparatus be welded onto the compressor housing. The required mounting hardware and welding operation not only increases manufacturing cost of the compressor, but also subjects the housing to extreme heat which may result in undesired deformation of the housing. Also, the provision of a mounting plate and legs projecting from the housing could make assembly and shipping of the compressor more difficult.

In other prior art mounting methods, the bottom of the compressor rests on resilient means interposed between the bottom of the compressor and the supporting base. For example, resilient grommets may be adhesively bonded within indentations on the bottom of a compressor housing, wherein the grommets are then mounted onto projections on the mounting base. In another mounting system of this type, the compressor rests upon a resilient member comprising a plurality of hollow spring cylinders engaging locations on the bottom of the compressor housing. In this latter mounting system, the compressor must be supported at its top end to insure vertical stability. This typically requires that a mounting stud be welded to the compressor housing and that additional support structure be provided, thereby adding to the cost and complexity of the mounting system.

While various and several methods of mounting a compressor to an appliance cabinet or the like are known, it is desired to provide an improved mounting system, wherein both vibration imparted to the supporting base and noise radiating from the compressor housing are minimized. The problem of noise radiating from the compressor housing is particularly pronounced in the case of a compressor housing wherein an end plate of the compressor mechanism within the housing forms one end of the compressor housing. In such an arrangement, particularly where the end plate is adjacent the cylinder block of a rotary vane compressor mechanism, noises tend to radiate from the end plate.

Accordingly, it is desired to provide an improved mounting apparatus for mounting a hermetic compressor to a horizontal support surface in an upright position, wherein additional mounting hardware on the compressor housing is not required and vibration and noise radiating from the compressor housing is suppressed.

SUMMARY OF THE INVENTION

The present invention provides a mounting apparatus for mounting a hermetic compressor to a horizontal support surface in an upright position, wherein a resilient member engages the bottom end of the compressor outer housing so as to substantially cover the housing bottom end, thereby isolating compressor vibration and suppressing noise radiating from the bottom end of the housing.

In general, the invention provides a resilient cup-shaped body member having a bottom surface attachable to a horizontal support surface and a top surface including a receptacle to receive the bottom end of the compressor housing. The receptacle includes an opening on the top surface and a downwardly extending sidewall. When the compressor is received into the receptacle, the sidewall frictionally engages the compressor housing to ensure vertical stability. In one aspect of the invention, the receptacle includes a bottom wall, which is spaced from the bottom of the compressor housing when the compressor is received in the receptacle, whereby the compressor housing and receptacle define a substantially enclosed chamber for suppressing noise radiating from the bottom of the housing.

More specifically, the invention provides, in one form thereof, a resilient cup-shaped body member including a generally cylindrical wall portion having a diameter less than the diameter of the generally cylindrical sidewall of the compressor housing. Accordingly, when the bottom end of the compressor housing is force-fittedly introduced into the body member, the sidewall is resiliently biased against the compressor housing to retain the bottom end of the compressor within the body member. In one aspect of the invention according to this form thereof, the bottom end of the compressor housing includes a radially extending flange portion, which causes a circumjacent portion of the sidewall to be stretched radially outwardly so as to envelope the flange portion, thereby restricting vertical movement of the compressor. In accordance with this aspect of the invention, the location of engagement of the flange portion with the sidewall is spaced from the intersection between the sidewall and a bottom wall of the cup-shaped body member.

An advantage of the mounting boot of the present invention is that a compressor may be mounted to a support base without the need for hardware welded to the outside of the compressor housing.

Another advantage of the mounting boot of the present invention is that sound radiating from the bottom of the compressor housing is suppressed.

A further advantage of the mounting boot of the present invention is that suppression of vibration and sound from a compressor mounted within an appliance cabinet is simply and economically achieved.

Another advantage of the mounting boot of the present invention is that the particular frictional engagement of the boot with the compressor housing is maintained despite vibratory and shock forces that might otherwise cause disengagement.

A still further advantage of the mounting boot of the present invention, in one form thereof, is that mounting of a compressor to a support base is accomplished with a single part, i.e., a resilient body member, thereby simplifying installation.

Another advantage of the mounting boot of the present invention, in one form thereof, is the versatility in mounting the boot to any horizontal support base, due to the provision of integrally formed, radially extending mounting feet.

Yet another advantage of the mounting boot of the present invention is that refrigeration fluid conduits present on the mounting end of the compressor housing may be accommodated by the provision of passages formed in the mounting boot.

The invention, in one form thereof, provides a vertically upright hermetic compressor for mounting to a horizontal support surface. The compressor includes a housing having a motor compressor unit operably disposed therein. A mounting apparatus is removably attached to the bottom end of the housing, whereby the compressor may be mounted to the horizontal support surface. The mounting apparatus comprises a resilient body member engaged with the housing to substantially cover the housing bottom end.

The invention further provides, in one form thereof, a mounting apparatus for mounting a hermetic compressor to a horizontal support surface in a vertically upright manner. The mounting apparatus comprises a resilient body member including a bottom surface and a top surface. The bottom surface is attachable to the horizontal support surface, while the top surface includes a receptacle for receiving a bottom portion of the compressor. The receptacle comprises an opening on the body member top surface, and a sidewall adapted to frictionally engage the compressor.

The invention still further provides, in one form thereof, a vertically upright hermetic compressor for mounting to a horizontal support surface. The compressor comprises an outer housing having operably disposed therein a motor compressor unit. The housing includes a top end, a generally cylindrical central portion, and a bottom end. The housing also includes a radially outwardly extending flange portion adjacent the bottom end. In one aspect of the invention, the housing bottom end comprises a plate member constituting a part of the motor compressor unit. The compressor also includes a cup-shaped body member, attachable to the horizontal support surface, for mounting the compressor to the horizontal support surface in a vertically upright manner. The body member includes a resilient upwardly extending wall portion having a generally cylindrical inner wall with which the flange portion operably engages. The inner wall has a diameter less than the diameter of the flange portion, whereby the wall portion is resiliently biased against the flange portion. In another aspect of the present invention according to this form, the body member includes a bottom wall generally intersecting at its perimeter with the cylindrical inner wall of the wall portion. In such an arrangement, a spacer is provided for spacing the location of engagement of the compressor with the inner wall from the intersection between the bottom wall and the inner wall when the compressor is operably mounted within the mounting apparatus. Alternatively, the body member may include a bottom wall having a peripheral planar portion against which the compressor bottom end abuts. In this arrangement, the planar portion has an annular channel formed therein adjacent the wall portion to axially extend the cylindrical inner wall below the planar portion.

DESCRIPTION OF THE PREFERRED EMBODIMENT

Figure 1:
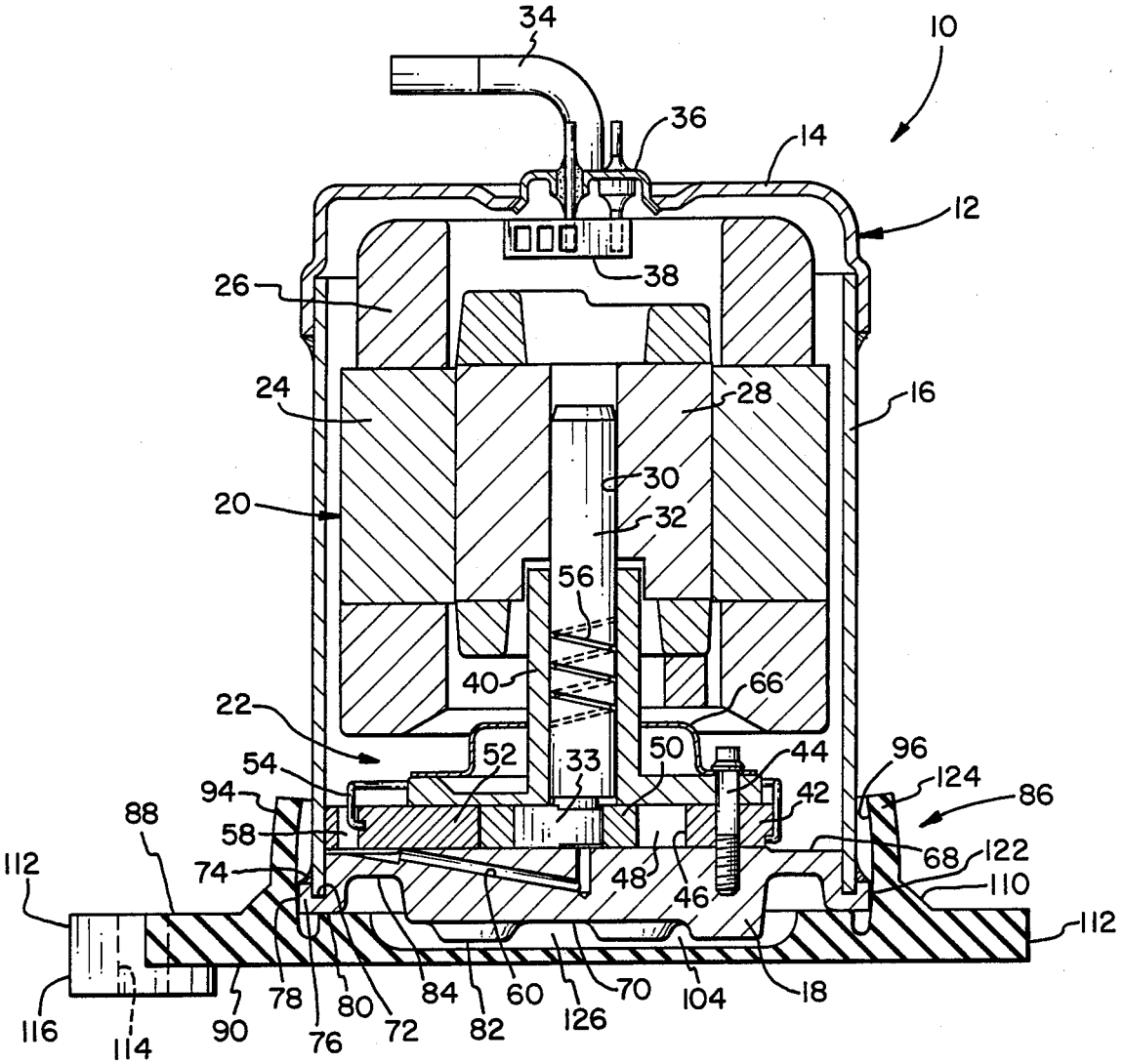
FIG. 1 is a side sectional view of a hermetic compressor and mounting boot assembly in accordance with the present invention.

In an exemplary embodiment of the invention as shown in the drawings, and in particular by referring to FIG. 1, a vertical axis hermetic compressor 10 is shown having a housing generally designated at 12. Housing 12 comprises a top portion 14, a generally cylindrical central portion 16, and a bottom end plate 18. The three housing portions are hermetically secured together as by welding or brazing. Disposed within housing 12 is a motor compressor unit comprising an electric motor generally designated at 20 and a rotary vane compressor mechanism generally designated at 22. Motor 20 comprises a stator 24 having windings 26, and a rotor 28. Stator 24 is secured to housing 12 by an interference fit, such as by shrink fitting.

Rotor 28 has a central aperture 30 provided therein into which is secured a rotatable crankshaft 32, such as by an interference fit. Crankshaft 32 includes an eccentric portion 33 drivingly connected to compressor mechanism 22, which compresses refrigerant for discharge into the interior of housing 12. A refrigerant discharge tube 34 is sealingly connected to top portion 14 of the housing as by soldering. Likewise, a hermetic electric terminal 36 is also secured to top portion 14, wherein a connector 38 connects to terminal 36 on the interior of housing 12 to supply electric power to motor 20.

As previously described, compressor mechanism 22 of the illustrated embodiment is a rotary vane compressor mechanism substantially the same as that shown and described in U.S. Pat. No. 4,730,994, issued to Maertens and assigned to the same assignee as the present invention, the disclosure of which is hereby incorporated herein by reference. A brief description of compressor mechanism 22 is provided herein to aid in the understanding of the present invention. Accordingly, compressor mechanism 22 includes a main bearing 40 in which crankshaft 32 is rotatably journalled, end plate 18, and a compressor cylinder block 42 disposed intermediate main bearing 40 and end plate 18. As illustrated in FIG. 1, end plate 18 is secured to main bearing 40 by means of a plurality of bolts 44.

Cylinder block 42 defines an axial bore 46 which, together with main bearing 40 and end plate 18, defines a compression chamber 48. A roller 50 surrounds crankshaft eccentric 33 in compression chamber 48, and cooperates with a sliding vane 52 in a conventional manner for compressing a refrigerant fluid in compression chamber 48. Furthermore, a vane spring 54 provides a bias force to the back of the sliding vane 52. Compressor mechanism 22 also includes a lubrication system, more fully described in U.S. Pat. No. 4,730,994, including helical passageways 56 formed in crankshaft 32, axial passage 58 formed in cylinder block 42, and radial passage 60 formed in end plate 18.

Figure 2:
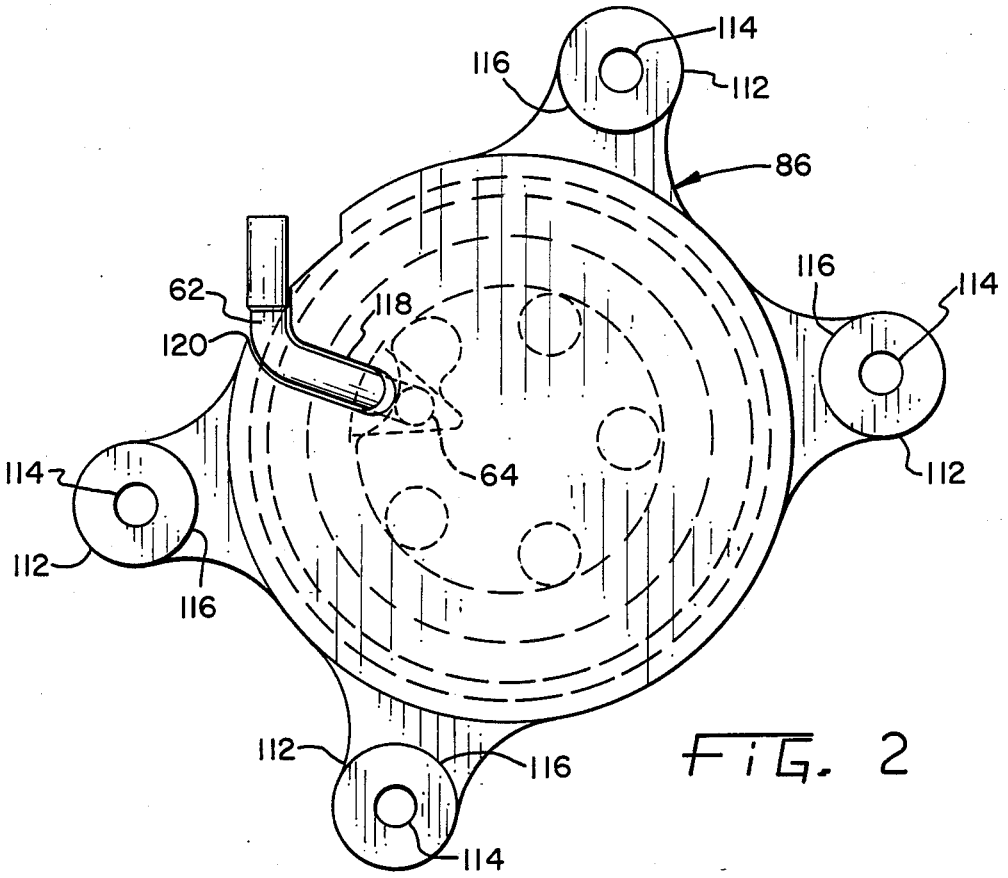
FIG. 2 is a bottom view of the hermetic compressor and mounting boot assembly of FIG. 1, particularly showing the suction inlet tube of the compressor.

In operation of compressor 10, gas refrigerant enters compressor mechanism 22 through a suction inlet tube 62 mounted to a suction aperture 64 provided in end plate 18, as shown in FIG. 2. Gas refrigerant flowing into aperture 64 enters compression chamber 48 and is compressed by operation of roller 50 and sliding vane 52 as crankshaft 32 is rotatingly driven by rotor 28 of motor 20. Thereafter, the compressed refrigerant is discharged through a discharge valve (not shown) into the interior of housing 12 through a discharge muffler 66, and then through discharge tube 34 to the condenser of a refrigeration circuit as known in the art.

End plate 18, as previously described, constitutes a part of compressor mechanism 22, while at the same time serves as the bottom end of housing 12. More specifically, end plate 18 is a circular-shaped plate member having a top surface 68 and a bottom surface 70. At the periphery of end plate 18, an annular groove 72 is formed in top surface 68, into which central portion 16 is received and secured to end plate 18 by means of weldment 74. As illustrated in FIG. 1, end plate 18 includes a flange portion 76 having greater diameter than central portion 16 and, hence, extending radially outwardly therefrom. Flange portion 76 includes a radially outwardly facing surface 78. FIG. 1 also illustrates that end plate bottom surface 70 generally comprises a radially outermost annular support surface 80, a radially innermost circular area 82, and a radially intermediate annular recess 84, wherein surface 80 is located in a plane axially between planar area 82 and the planar bottom of recess 84.

In accordance with the principles of the present invention, a resilient, cup-shaped mounting boot 86 is removably attached to the bottom end of compressor 10 so as to mount compressor 10 in an upright position on a horizontal support surface (not shown). In accordance with a preferred embodiment, mounting boot 86 is a unitary body member, molded from Santoprene thermoplastic rubber material available from Monsanto Corporation of St. Louis, Mo. However, it will be appreciated that other suitable resilient rubber-like materials may be used. FIGS. 1 and 2 illustrate mounting boot 86 operably engaged with compressor 10, while FIGS. 3 and 4 illustrate specific structural features of mounting boot 86 more fully described hereinafter.

Figure 4:
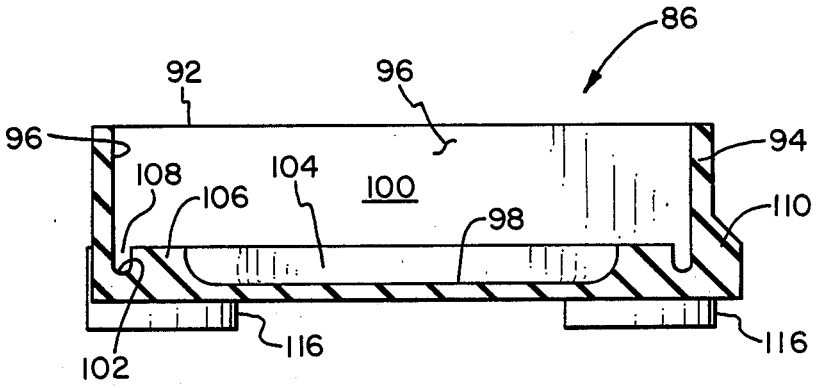
FIG. 4 is a sectional view of the mounting boot of FIG. 1, taken along the line 4—4 in FIG. 3 and viewed in the direction of the arrows.
Figure 3:
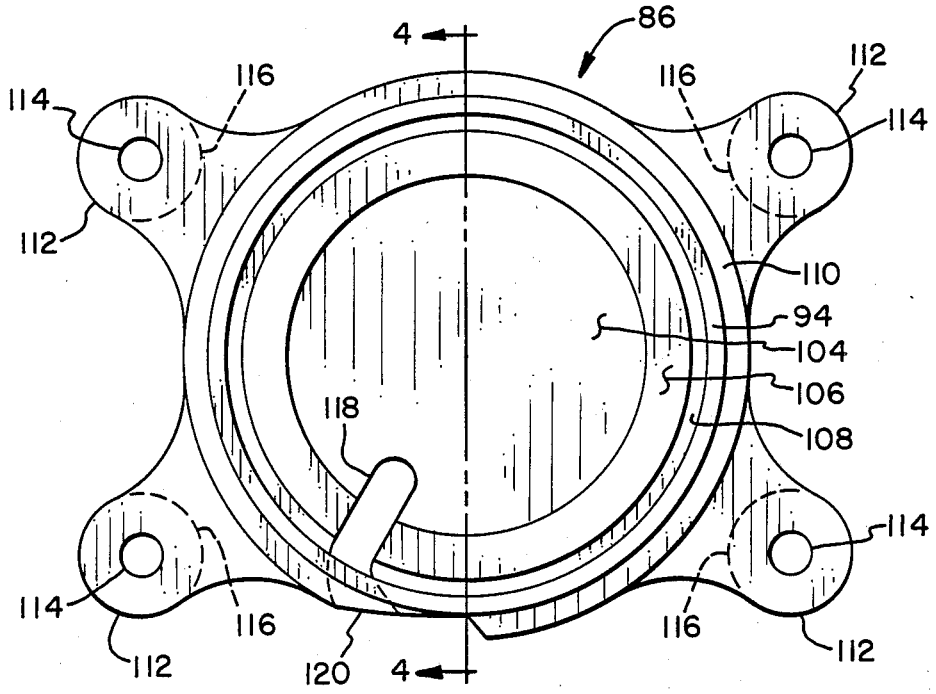
FIG. 3 is a top view of the mounting boot of FIG. 1.

Referring now to FIGS. 2–4, mounting boot 86 comprises a cup-shaped body member including a top surface 88 and a substantially horizontal bottom surface 90. Top surface 88 includes an opening 92, an upwardly extending wall portion 94 having an inwardly facing sidewall 96, and a bottom wall 98, which together define a receptacle 100 into which the bottom end of compressor 10 is received through opening 92. Sidewall 96 extends downwardly so as to generally intersect with bottom wall 98 at a perimeter 102 thereof. Bottom wall 98 includes a central recess 104, an annular platform 106 circumjacent recess 104, and an annular channel 108 circumjacent platform 106. As illustrated, recess 104 and channel 108 represent areas of bottom wall 98 having a reduced axial thickness. An annular bevelled shoulder 110 is provided on the outside of wall portion 94 adjacent top surface 88.

In accordance with one embodiment of the present invention, mounting boot 86 has integrally formed therewith a plurality of radially extending foot portions 112 for mounting the boot to a horizontal support surface within an appliance frame, enclosure, or cabinet. Each foot portion 112 includes an aperture 114 extending axially therethrough, which may house a sleeve through which a nut and bolt assembly is received to secure mounting boot 86 to the support surface. Each foot portion 112 also includes a spacer portion 116, whereby spacer portions 116 contact with the horizontal support surface while maintaining bottom surface 90 spaced therefrom. Alternatively, mounting boot 86 may be attached to a horizontal support surface without foot portions 112. For example, bottom surface 90 could directly contact the support surface and the attached thereto with an adhesive or the like.

Referring to FIGS. 2 and 3, suction inlet tube 62 extends from bottom surface 70 of compressor 10, and passes through a passage 118 formed in bottom wall 98 of boot 86. More specifically, passage 118 extends radially outwardly to an opening 120 on the outer periphery of boot 86, whereby suction inlet tube extends axially downwardly from bottom surface 70, makes a right-angled turn, and extends radially outwardly from the mounting boot, as shown in FIG. 2.

Referring once again to FIG. 1, the engagement of mounting boot 86 with compressor housing 12, in accordance with a preferred embodiment of the invention, will now be more fully described. Generally, the compressor housing is frictionally engaged by the mounting boot, whereby the bottom end of the compressor housing is substantially covered by the mounting boot and the compressor is prevented from moving vertically out of its mounted position without the requirement of additional mounting hardware. More specifically, outwardly facing surface 78 of flange portion 76 engages sidewall 96 of boot 86. The outside diameter of flange 76 is slightly larger than the inside diameter of sidewall 96, whereby the sidewall is resiliently biased against the flange portion when the compressor is operably mounted. For example, in one embodiment of the invention, the outside diameter of flange 76 is approximately 4.905 inches, while the inside diameter of sidewall 96 is approximately 4.830 inches.

As illustrated in FIG. 4, cylindrical wall portion 94 is substantially vertical in the absence of compressor 10 being engaged with boot 86. However, as illustrated in FIG. 1, when the bottom end of compressor 10 is inserted into receptacle 100, the aforementioned difference in diameters causes a bowing out of wall 94 centered at a point of contact 122 of flange 76 with wall 94, whereat radially outward force is exerted on sidewall 96. More specifically, an uppermost portion 124 of wall 94 tends to curl radially inwardly over the point of contact 122 or, in other words, the sidewall is stretched radially outwardly so as to envelope the flange portion. This bowing or enveloping action restrains the compressor against vertical movement caused by vibratory and/or shock forces.

Another important aspect of the present invention is that the location of engagement of flange 76 with wall 94, i.e., point of contact 122, is spaced from the intersection between sidewall 96 and bottom wall 98 at perimeter 102. If the point of contact 122 were permitted to approach the intersection between the bottom and side walls, wall 96 would no longer be able to envelope the flange portion just below the point of contact. Accordingly, the radially outward force on wall 96 would become leveraged so as to cause bottom wall 98 to bow upwardly at the center thereof, and wall 94 to open in conical fashion, thereby reducing the restraint of the compressor in the vertical direction.

To insure that point of contact 122 remains axially spaced from the point of intersection at perimeter 102, annular channel 102 and platform 106 cooperate so that annular support surface 80 abuts against platform 106, whereby annular channel 108 effectively permits sidewall 96 to extend below the planar top surface of platform 106, as illustrated in FIG. 1. Accordingly, when compressor 10 is inserted into receptacle 100 so that support surface 80 abuts the top surface of platform 106, flange 76 exerts a radially outward force on wall 94 at a point of contact 122 spaced from the intersection between the side and bottom walls of boot 86 at perimeter 102. This spacing permits wall 96 to surround or envelope flange 76 for vertical stability of compressor 10.

Finally, the previously described abutment of annular support surface 80 with the top surface of annular platform 106 is designed such that bottom surface 70 remains spaced from bottom wall 98, particularly central recess 104, whereby a substantially enclosed chamber 126 is defined to suppress noise radiated from end plate 18 during compressor operation. Where end plate 18 constitutes a component of a rotary vane compressor mechanism which helps define the compression chamber, the noise radiated from end plate 18 can be especially pronounced. Accordingly, in the preferred embodiment of the present invention described herein, the provision of chamber 126 for suppression of noise radiated from the bottom end of the compressor housing is particularly advantageous.

It will be appreciated that the foregoing is presented by way of illustration only, and not by way of any limitation, and that various alternatives and modification may be made to the illustrated embodiment without departing from the spirit and scope of the invention.

What is claimed is:

1. A vertically upright hermetic compressor for mounting to a horizontal support surface, comprising:
- a housing including a top end, a bottom end, and a generally cylindrical central portion therebetween;
- a motor compressor unit operably disposed within said housing; and
- mounting means, removably attached to said housing bottom end, for mounting said compressor to the horizontal support surface, said mounting means comprising a resilient body member, including a generally horizontal bottom portion overlying said housing bottom end and an upstanding sidewall portion circumferentially engaged with said housing central portion adjacent said housing bottom end, to substantially cover said housing bottom end.

2. The compressor of claim 1 in which said resilient body member is frictionally engaged with said housing.

3. The compressor of claim 1 in which:
- said housing includes a generally horizontal bottom end wall and a generally vertical sidewall, said resilient body member being in engagement with said sidewall adjacent said bottom end wall.

4. The compressor of claim 1, and further comprising:
- a conduit providing fluid communication between said motor compressor unit and the exterior of said housing, said conduit exiting said housing at said bottom end thereof, said resilient body member including a passage through which said conduit is received such that said housing bottom end remains substantially covered.

5. The compressor of claim 1 in which:
- said mounting means includes attachment means, integrally formed with said resilient body member, for attaching said mounting means to the horizontal support surface.

6. The compressor of claim 5 in which said attachment means comprises a plurality of radially extending foot portions.

7. A mounting apparatus for mounting a hermetic compressor to a horizontal support surface in a vertically upright manner, comprising:
- a resilient body member, including a bottom surface attachable to the horizontal support surface, and a top surface having receptacle means for receiving a bottom portion of the compressor, said receptacle means comprising a recess in said stop surface defined by a bottom wall adapted to substantially cover an axially downwardly facing surface of the bottom portion of the compressor and a sidewall adapted to frictionally engage a radially outwardly facing sidewall of the bottom portion of the compressor.

8. The mounting apparatus of claim 7 in which:
- said body member includes at least one aperture extending therethrough, adapted to accommodate passage therethrough of a fluid carrying conduit of the hermetic compressor when received within said receptacle means.

9. The mounting apparatus of claim 7 in which:
- said body member includes attachment means integrally formed therewith for attaching said mounting apparatus to the horizontal support surface.

10. The mounting apparatus of claim 9 in which said attachment means comprises a plurality of radially extending foot portions.

11. A vertically upright hermetic compressor for mounting to a horizontal support surface, comprising:
- an outer housing having operably disposed therein a motor compressor unit, said housing including a top end, a generally cylindrical central portion, a bottom end, and a radially outwardly extending flange portion adjacent said bottom end; and
- mounting means for mounting said compressor to the horizontal support surface in a vertically upright manner, said mounting means comprising a cup-shaped body member attachable to the horizontal support surface, said body member including a resilient upwardly extending wall portion having a generally cylindrical inner wall with which said flange portion is operably engaged, said inner wall having a diameter less than the diameter of said flange portion such that said wall portion is resiliently biased against said flange portion.

12. The compressor of claim 11 in which:

said housing bottom end comprises a plate member constituting a part of said motor compressor unit, said plate member being sealingly attached to said housing central portion and forming said flange portion at the outer periphery thereof.

13. The compressor of claim 11 in which:

said body member includes a bottom wall circumscribed by said cylindrical inner wall of said wall portion, said bottom wall having a reduced thickness along an annular peripheral portion adjacent said inner wall.

14. The compressor of claim 11 in which:

said body member includes a bottom wall having a peripheral planar portion against which said compressor bottom end abuts, said planar portion having an annular channel formed therein adjacent said wall portion to axially extend said cylindrical inner wall below said planar portion.

15. A mounting boot for mounting a hermetic compressor to a horizontal support surface, wherein the compressor includes a housing having top and bottom ends and a generally cylindrical central portion, said boot comprising:

a resilient cup-shaped body member including a generally horizontal bottom portion attachable to the horizontal support surface, and an annular upstanding sidewall portion having an inwardly facing surface adapted to circumferentially engage the compressor central portion such that the compressor bottom end is substantially covered.

16. The mounting boot of claim 15 in which:

said member includes a bottom wall generally intersecting at its perimeter with said sidewall portion, and means for spacing the location of engagement of the compressor with said inwardly facing surface from said intersection between said bottom wall and said sidewall portion when the compressor is operably mounted within said mounting boot.

17. The mounting boot of claim 16 in which:

said spacing means comprises a platform extending upwardly from said bottom wall, against which the compressor abuts when operably mounted within said mounting boot.

18. The mounting boot of claim 16 in which:

said spacing means comprises a support wall extending upwardly from said bottom wall, said support wall running continuously about a peripheral portion of said bottom wall in spaced relation to said sidewall, said support wall including a top surface against which the compressor abuts when operably received within said mounting boot, whereby said bottom wall, said support wall, and the bottom end of the compressor define a substantially enclosed chamber for muffling sound radiated from the bottom end of the compressor.

19. The mounting boot of claim 15 in which:

said body member includes at least one aperture extending therethrough, adapted to accommodate passage therethrough of a fluid carrying conduit of the hermetic compressor when operably received within said mounting boot.

20. The mounting boot of claim 15 in which:

said body member includes attachment means integrally formed therewith for attaching said mounting boot to the horizontal support surface.

21. The mounting boot of claim 20 in which:

said attachment means comprises a plurality of radially extending foot portions.

22. The mounting boot of claim 21 in which:

said body means includes a substantially planar bottom surface and said foot portions include spacer means for spacing said bottom surface from the horizontal support surface.

23. A vertically upright hermetic compressor for mounting to a horizontal support surface, comprising:

a housing having a bottom end including a generally horizontal bottom end wall and a generally vertical sidewall;

a motor compressor unit operably disposed within said housing; and mounting means, removably attached to said housing bottom end, for mounting said compressor to the horizontal support surface, said mounting means comprising a resilient body member in engagement with said sidewall adjacent said bottom end wall to substantially cover said housing bottom end, said resilient body member and said bottom end wall being spaced apart to define a substantially enclosed chamber for muffling sound produced by said motor compressor unit and radiated from said housing bottom end.

24. A vertical upright hermetic compressor for mounting to a horizontal support surface, comprising:

a housing including a bottom end;

a motor compressor unit operably disposed within said housing; and mounting means, removably attached to said housing bottom end, for mounting said compressor to the horizontal support surface, said mounting means comprising a resilient body member engaged with said housing to substantially cover said housing bottom end;

said resilient body member including a top surface having receptacle means for receiving a bottom portion of the compressor, said receptacle means comprising an opening on said top surface, a sidewall adapted to frictionally engage the compressor, and a bottom wall generally intersecting at its perimeter with said sidewall, said resilient body member further including means for spacing the location of said frictional engagement of the compressor with said sidewall from said intersection between said bottom wall and said sidewall when the bottom portion of the compressor is received within said receptacle means.

25. The compressor of claim 24 in which:

said spacing means comprises a platform extending upwardly from said bottom wall, against which the compressor abuts when received within said receptacle means.

26. The compressor of claim 24 in which:

said spacing means comprises a support wall extending upwardly from said bottom wall, said support wall running continuously about a peripheral portion of said bottom wall in spaced relation to said sidewall, said support wall including a top surface against which the compressor abuts when received within said receptacle means, whereby said bottom wall, said support wall, and the bottom portion of the compressor define a substantially enclosed chamber for muffling sound radiated from the bottom portion of the compressor.

27. A vertically upright hermetic compressor for mounting to a horizontal support surface, comprising:

a housing including a bottom end;

a motor compressor unit operably disposed within said housing; and mounting means, removably attached to said housing bottom end, for mounting said compressor to the horizontal support surface, said mounting means comprising a resilient body member having a substantially planar bottom surface and being engaged with said housing to substantially cover said housing bottom end, and attachment means, integrally formed with said resilient body member, for attaching said mounting means to the horizontal support surface, said attachment means comprising a plurality of radially extending foot portions including spacer means for spacing said bottom surface of said resilient body member from the horizontal support surface.

28. A mounting apparatus for mounting a hermetic compressor to a horizontal support surface in a vertically upright manner, comprising:

a resilient body member, including a bottom surface attachable to the horizontal support surface and a top surface having receptacle means for receiving a bottom portion of the compressor, said receptacle means comprising an opening on said top surface, a sidewall adapted to frictionally engage the compressor, and a bottom wall generally intersecting at its perimeter with said sidewall, said body member including means for spacing the location of said frictional engagement of the compressor with said sidewall from said intersection between said bottom wall and said sidewall when the bottom portion of the compressor is received within said receptacle means.

29. The mounting apparatus of claim 28 in which:

said spacing means comprises a platform extending upwardly from said bottom wall, against which the compressor abuts when received within said receptacle means.

30. The mounting apparatus of claim 28 in which:

said spacing means comprises a support wall extending upwardly from said bottom wall, said support wall running continuously about a peripheral portion of said bottom wall in spaced relation to said sidewall, said support wall including a top surface against which the compressor abuts when received within said receptacle means, whereby said bottom wall said support wall, and the bottom portions of the compressor define a substantially enclosed chamber for muffling sound radiated from the bottom portion of the compressor.

31. A mounting apparatus for mounting a hermetic compressor to a horizontal support surface in a vertical upright manner, comprising:

a resilient body member, including a substantially planar bottom surface attachable to the horizontal support surface and a top surface having receptacle means for receiving a bottom portion of the compressor, said receptacle means comprising an opening on said top surface and a sidewall adapted to frictionally engage the compressor, said resilient body member further including attachment means integrally formed therewith for attaching said mounting apparatus to the horizontal support surface, said attachment means comprising a plurality of radially extending foot portions including spacer means for spacing said bottom surface of said resilient body member from the horizontal support surface.

* * * * *